US012410808B2

(12) United States Patent
Mitsuda et al.

(10) Patent No.: US 12,410,808 B2
(45) Date of Patent: Sep. 9, 2025

(54) CRUDE OIL EXTRACTION PUMP

(71) Applicant: MITSUBISHI HEAVY INDUSTRIES, LTD., Tokyo (JP)

(72) Inventors: Kimihiko Mitsuda, Tokyo (JP); Shuhei Sasaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/275,482

(22) PCT Filed: Feb. 18, 2021

(86) PCT No.: PCT/JP2021/006058

§ 371 (c)(1),
(2) Date: Aug. 2, 2023

(87) PCT Pub. No.: WO2022/176092

PCT Pub. Date: Aug. 25, 2022

(65) Prior Publication Data

US 2024/0309875 A1 Sep. 19, 2024

(51) Int. Cl.
*F04D 29/06* (2006.01)
*F04D 13/08* (2006.01)
(Continued)

(52) U.S. Cl.
CPC ..... *F04D 29/061* (2013.01); *F04D 13/086* (2013.01); *F04D 29/049* (2013.01); *F04D 29/448* (2013.01)

(58) Field of Classification Search
CPC ..... F04D 13/08; F04D 13/086; F04D 13/10; F04D 29/046; F04D 29/049; F04D 29/06; F04D 29/061; F04D 29/445; F04D 29/448
(Continued)

(56) References Cited

U.S. PATENT DOCUMENTS 3,288,075 A 11/1966 Lung
4,135,852 A * 1/1979 Archibald ..... F04D 1/066 415/121.2
(Continued)

FOREIGN PATENT DOCUMENTS

CN 109372758 A * 2/2019 ..... F04D 1/06
JP H07-038675 U 7/1995
(Continued)

OTHER PUBLICATIONS

International Search Report dated Apr. 27, 2021, issued in counterpart Application No. PCT/JP2021/006058. (5 pages).
(Continued)

*Primary Examiner* — Essama Omgba
*Assistant Examiner* — Chirag Jariwala
(74) *Attorney, Agent, or Firm* — WHDA, LLP

(57) ABSTRACT

A crude oil extraction pump includes: a production pipe having a tubular shape along an axis extending in a vertical direction; a pump rotor extending in a direction of the axis inside the production pipe; and a pump stator surrounding the pump rotor, wherein the pump rotor includes a pump shaft and an impeller which is provided in multiple stages and rotates together with the pump shaft to pump crude oil upward, and wherein the pump stator includes a stator body having a tubular shape, a plurality of vanes protruding radially inward from an inner peripheral surface of the stator body and are provided above the respective impellers, a diffuser hub which is formed on a radial inside of the vane, a bearing device which is installed on an inner peripheral side of the diffuser hub, and a hub extension portion which is formed at an upper end portion of the diffuser hub and having an outer peripheral surface having a constant outer diameter centered on the axis.

7 Claims, 5 Drawing Sheets

(51) Int. Cl.
*F04D 29/049* (2006.01)
*F04D 29/44* (2006.01)

(58) Field of Classification Search
USPC ..... 415/199.1–199.3
See application file for complete search history.

(56) References Cited

U.S. PATENT DOCUMENTS

| | | | | |
|---|---|---|---|---|
| 4,553,909 | A | 11/1985 | Galais et al. | |
| 2014/0178190 | A1* | 6/2014 | Gahlot et al. | F04D 13/10 415/199.1 |
| 2015/0132159 | A1 | 5/2015 | Wilson et al. | |
| 2018/0045213 | A1 | 2/2018 | Groppo et al. | |
| 2020/0232473 | A1* | 7/2020 | Davis | F04D 29/046 |
| 2020/0378397 | A1* | 12/2020 | Kawashita et al. | E21B 43/128 |
| 2022/0205452 | A1 | 6/2022 | Mitsuda et al. | |

FOREIGN PATENT DOCUMENTS

| | | | |
|---|---|---|---|
| JP | 2003-056481 | A | 2/2003 |
| JP | 2018-508701 | A | 3/2018 |
| JP | 2020-197149 | A | 12/2020 |
| JP | 2021-028479 | A | 2/2021 |
| WO | 03/098049 | A1 | 11/2003 |

OTHER PUBLICATIONS

Written Opinion dated Apr. 27, 2021, issued in counterpart Application No. PCT/JP2021/006058, with English Translation. (10 pages).

* cited by examiner

CRUDE OIL EXTRACTION PUMP

TECHNICAL FIELD

The present disclosure relates to a crude oil extraction pump.

BACKGROUND ART

A pump called an electrical submersible pump (ESP) has been widely used as a device for pumping up crude oil from an oil well. As shown in Patent Document 1 below, a pump includes a rotation shaft which rotates around a rotation axis, a plurality of impellers which are integrally provided with this rotation shaft, and a casing which covers the rotation shaft and the impellers from an outer peripheral side. This pump is disposed in a pipe inserted into a well (oil well) and the rotation shaft is rotated by an electric motor to pump underground oil upwards.

Here, in recent years, pumps using canned motors as electric rotating machines have been proposed for the purpose of improving maintainability and making equipment more compact. This type of pump includes a production pipe which is inserted into an oil well, a motor rotor which is disposed inside the production pipe, a motor stator which is integrally provided on an inner peripheral side of the production pipe, a pump rotor which is integrally provided with an upper side of the motor rotor, a pump stator which covers this pump rotor from an outer peripheral side and forms a flow path allowing crude oil to flow therethrough, and a bearing device which rotatably supports the pump rotor with respect to the production pipe. The motor stator includes a coil and a magnet is provided on an outer peripheral surface of the motor rotor facing the motor stator. By energizing the coil, the motor rotor and the pump rotor are rotated by an electromagnetic force. Accordingly, crude oil is sucked up from a lower end of the pump.

CITATION LIST

Patent Document(s)

Patent Document 1: Japanese Patent Application National Publication (Laid-Open) No. 2018-508701

SUMMARY OF INVENTION

Technical Problem

Incidentally, in the above-described pump, the bearing device is inevitably exposed to the crude oil. Since slurry is mixed with the crude oil, the wear of the sliding portion will be accelerated if slurry flows into the bearing device. As a result, there is concern that the stable operation of the pump is hindered.

The present disclosure has been made in view of the above-described problems and an object is to provide a crude oil extraction pump that can be operated more stably.

Solution to Problem

In order to solve the above-described problems, a crude oil extraction pump according to the present disclosure includes: a production pipe having a tubular shape along an axis extending in a vertical direction; a pump rotor extending in a direction of the axis inside the production pipe; and a pump stator which is provided between the production pipe and the pump rotor to surround the pump rotor, wherein the pump rotor includes a pump shaft extending in the direction of the axis, and an impeller which is provided in multiple stages on the pump shaft and rotated together with the pump shaft to pump crude oil upward, and wherein the pump stator includes a stator body having a tubular shape extending along the axis, a plurality of vanes protruding radially inward in the axis from an inner peripheral surface of the stator body and are provided above the respective impellers, an annular diffuser hub which is formed on the radial inside of the vane and has a bearing device rotatably supporting the pump shaft provided on an inner peripheral side thereof, and a hub extension portion which is formed at an upper end portion of the diffuser hub and having an outer peripheral surface having a constant outer diameter centered on the axis.

Another crude oil extraction pump according to the present disclosure includes: a production pipe having a tubular shape along an axis extending in a vertical direction; a pump rotor extending in a direction of the axis inside the production pipe; and a pump stator which is provided between the production pipe and the pump rotor to surround the pump rotor, wherein the pump rotor includes a pump shaft extending in the direction of the axis and an impeller which is provided in multiple stages on the pump shaft and rotated together with the pump shaft to pump crude oil upward, wherein the pump stator includes a stator body having a tubular shape extending along the axis, a plurality of vanes protruding radially inward in the axis from an inner peripheral surface of the stator body and are provided above the respective impellers, and an annular diffuser hub which is formed on the radial inside of the vane and has a bearing device which is formed on an inner peripheral side of the diffuser hub and rotatably supporting the pump shaft, and wherein the pump rotor further includes an auxiliary impeller which is formed on an outer peripheral surface of the pump shaft and above the diffuser hub.

Yet another crude oil extraction pump according to the present disclosure includes: a production pipe having a tubular shape along an axis extending in a vertical direction; a pump rotor extending in a direction of the axis inside the production pipe; and a pump stator which is provided between the production pipe and the pump rotor to surround the pump rotor, wherein the pump rotor includes a pump shaft extending in the direction of the axis and an impeller which is provided in multiple stages on the pump shaft and rotated together with the pump shaft to pump crude oil upward, wherein the pump stator includes a stator body having a tubular shape extending along the axis, a plurality of vanes protruding radially inward in the axis from an inner peripheral surface of the stator body and are provided above the respective impellers, and an annular diffuser hub which is formed on the radial inside of the vane and has a bearing device which is installed on an inner peripheral side of the diffuser hub and rotatably supporting the pump shaft, wherein the crude oil extraction pump further comprises a return flow path which is formed to extract a part of a working fluid from a negative pressure surface side of the vane provided adjacent to the upper impeller in the multiple stages of impellers and returns the working fluid to the bearing device provided adjacent to the lower impeller, and wherein one end of the return flow path is opened on the negative pressure surface of the vane.

Advantageous Effects of Invention

According to the present disclosure, it is possible to provide a crude oil extraction pump that can be operated more stably.

DESCRIPTION OF EMBODIMENTS

First Embodiment (Configuration of Crude Oil Extraction Pump)

Figure 1:
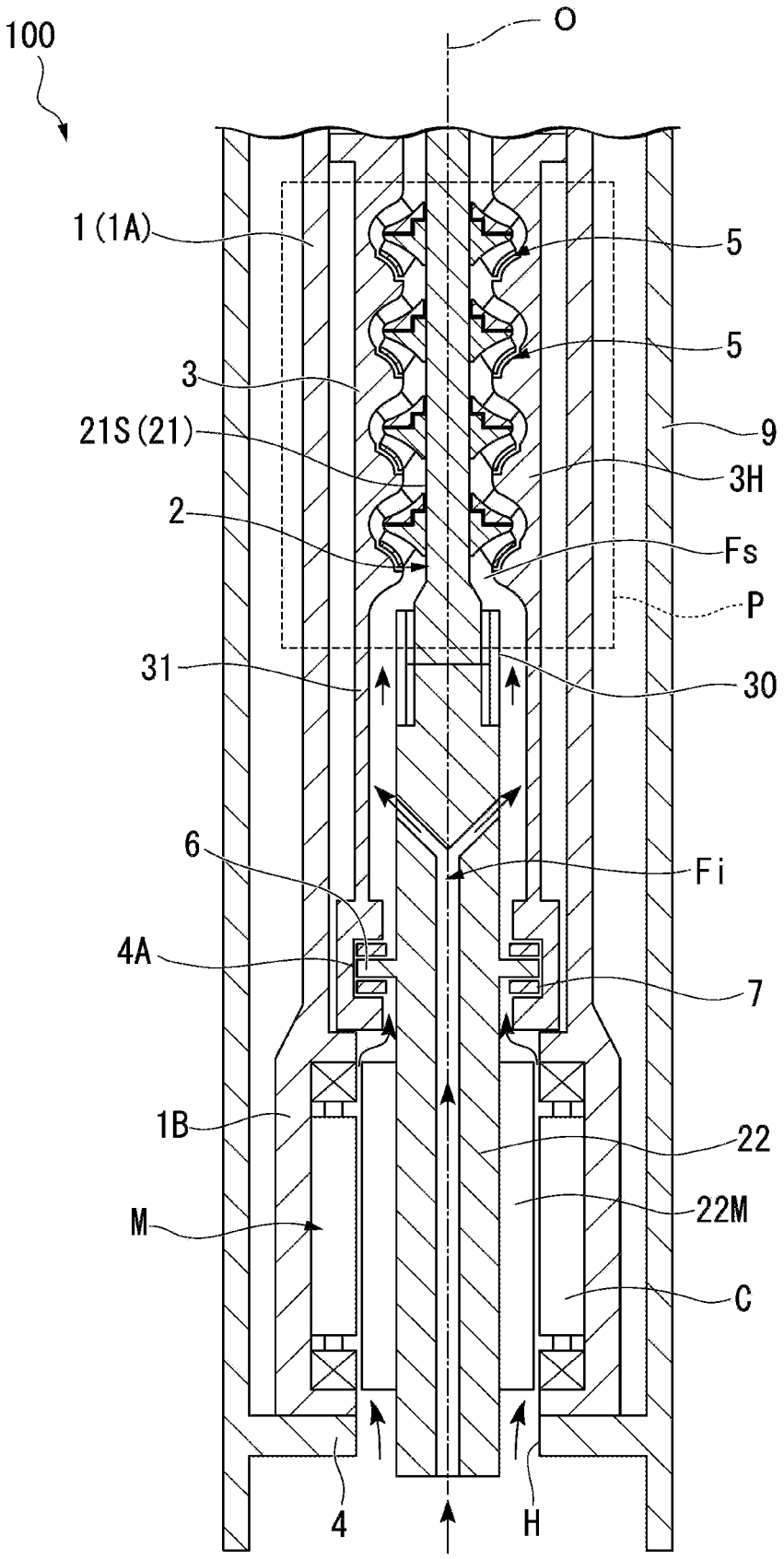
FIG. 1 is a longitudinal sectional view showing a configuration of a crude oil extraction pump according to a first embodiment of the present disclosure.

Hereinafter, a crude oil extraction pump 100 according to a first embodiment of the present disclosure will be described with reference to FIGS. 1 and 2. The crude oil extraction pump 100 includes a pump body P, a motor M, and a drilling pipe 9. The pump body P is driven by power supplied from the motor M. The drilling pipe 9 covers the pump body P and the motor M from the outer peripheral side and has a tubular shape centered on the axis O extending in the vertical direction.

(Configuration of Pump Body)

The pump body P includes a production pipe body 1A, a pump rotor 21, and a pump stator 3. A production pipe body 1A is a tubular member that is coaxial with the drilling pipe 9 and is disposed on the inner peripheral side of the drilling pipe 9. The pump rotor 21 includes a pump shaft 21S which extends in the direction of the axis O and a plurality of impellers 5 which are fixed to the pump shaft 21S.

The pump stator 3 includes a stator body 3H which covers the impeller 5 from the outer peripheral side, a stator extension portion 31, a plurality of vanes V, a diffuser hub 3D, a hub extension portion 3E, and a radial bearing 4B. The stator body 3H repeats expansion and contraction in diameter from below to above to accommodate the impeller 5 and define a stator flow path Fs through which crude oil flows. The stator extension portion 31 is integrally provided below the stator body 3H and has a tubular shape centered on the axis O. A thrust pad 7 is attached to the lower end of the stator extension portion 31. The configuration of the vane V, the diffuser hub 3D, and the hub extension portion 3E will be described.

(Configuration of Motor and Production Pipe)

The motor M includes a production pipe tip 1B, a motor rotor 22, a coil C, and a magnetic member 22M. The production pipe tip 1B has a tubular shape and is integrally provided below the production pipe body 1A. The production pipe body 1A and the production pipe tip 1B form the production pipe 1 as a whole. The inner peripheral surface of the production pipe tip 1B is provided with a plurality of coils C arranged in the circumferential direction. This coil C generates an electromagnetic force by a current supplied from the outside. The motor rotor 22 is disposed on the inner peripheral side of these coils C and has a columnar shape extending along the axis O. The motor rotor 22 is connected to the pump shaft 21S through a spline coupling 30. The pump shaft 21S and the motor rotor 22 form a rotor 2 as a whole. The outer peripheral surface of the motor rotor 22 is provided with a permanent magnet as the magnetic member 22M. A rotational force is applied to the rotor 2 by an electromagnetic force generated between a magnetic field generated by energizing the coil C and a magnetic field of the magnetic member 22M.

Further, the production pipe tip 1B is supported from below by an annular support portion 4 that protrudes radially inward from the inner peripheral surface of the drilling pipe 9. An opening on the inner peripheral side of the support portion 4 is formed as an opening portion H for taking in crude oil. The lower end of the motor rotor 22 is inserted through this opening portion H. A suction flow path Fi for sucking crude oil is formed inside the motor rotor 22 in addition to the opening portion H. This suction flow path Fi communicates with the stator flow path Fs formed on the inner peripheral side of the pump stator 3.

Further, an annular thrust collar 6 which protrudes radially outward and is centered on the axis O is provided on the outer peripheral surface of the motor rotor 22 and above the magnetic member 22M. This thrust collar 6 is supported from above and below by the thrust pad 7 provided on the inner peripheral surface of the pump stator 3 (stator extension portion 31). The thrust collar 6 and the thrust pad 7 form a thrust bearing 4A. The thrust bearing 4A and a radial bearing 4B (bearing device) to be described later support the rotor 2 (the pump rotor 21 and the motor rotor 22) to be rotatable around the axis O with respect to the pump stator 3.

(Configuration of Impeller)

Next, the configuration of the impeller 5 will be described with reference to FIG. 2. The impeller 5 includes a disk 51, a blade 52, and a shroud cover 53. The disk 51 is fixed to the outer peripheral surface of the pump shaft 21S and has a disk shape centered on the axis O. A downward facing surface of the disk 51 is a disk main surface 51M. The disk main surface 51M is curved from the inside to the outside in the radial direction from below to above.

The disk main surface 51M is provided with a plurality of blades 52 which are arranged at intervals in the circumferential direction. Although not shown in detail, each blade 52 is curved forward in the rotation direction of the rotor 2 as it goes from the inside to the outside in the radial direction. Further, the blade height (the rising dimension from the disk main surface 51M) of the blade 52 gradually decreases from below to above.

The upward facing surface (disk back surface 51B) of the disk 51 extends in a planar shape from the inside to the outside in the radial direction as it goes from below to above. The disk back surface 51B is provided with a partition portion 90. The partition portion 90 protrudes upward from the disk back surface 51B. The partition portion 90 has a cylindrical shape centered on the axis O. A space is formed on the radially inside of the partition portion 90. Additionally, the disk 51 is provided with a balance hole (not shown) that penetrates the disk 51 in the direction of the axis O from the disk main surface 51M toward the disk back surface 51B.

The shroud cover 53 has a funnel shape that covers the plurality of blades 52 from below. The shroud cover 53 is curved from the inside to the outside in the radial direction as it goes from below to above.

(Configuration of Vane, Diffuser Hub, and Hub Extension Portion)

The impeller 5 with the above-described configuration is covered by the stator body 3H from the outer peripheral side. In the inner peripheral surface of the stator body 3H, a surface facing the shroud cover 53 is formed as a facing surface P1. The facing surface P1 extends radially outward as it goes from below to above while forming a gap with respect to the outer peripheral surface of the shroud cover 53. In the inner peripheral surface of the stator body 3H, a region adjacent to the upper side of the facing surface P1 is a connection surface P2. The connection surface P2 is concave in a curved shape toward the radial outside. Further, a region adjacent to the upper side of the connection surface P2 is a downstream surface P3. The downstream surface P3 extends from the outside to the inside in the radial direction as it goes from below to above. This downstream surface P3 is provided with a plurality of vanes V and a diffuser hub 3D fixed to the inner peripheral side of the vane V. A region surrounded by the outer peripheral surface (the hub outer peripheral surface Sd) of the diffuser hub 3D and the downstream surface P3 is a diffuser flow path Fd for recovering the pressure of the working fluid (crude oil) flowing therein. The diffuser flow path Fd is a part of the above-described stator flow path Fs. Each vane V has a plate shape protruding radially inward from the downstream surface P3. A plurality of the vanes V are arranged at intervals in the circumferential direction.

The diffuser hub 3D faces the above-described disk back surface 51B from above. A protrusion portion Pt and a stepped portion D1 are provided on the downward facing surface (hub bottom surface 3B) of the diffuser hub 3D in order from the outside to the inside in the radial direction. The protrusion portion Pt protrudes downward to cover the radially outer edge of the disk 51 from the radial outside with a gap therebetween. The stepped portion D1 covers the partition portion 90 provided on the disk back surface 51B from the radial outside. That is, a radial inner portion of the stepped portion D1 in the hub bottom surface 3B is recessed upward from the radially outer portion.

The upper end portion of the diffuser hub 3D is provided with a hub extension portion 3E which is integrally formed with the diffuser hub 3D. The hub extension portion 3E has a cylindrical shape centered on the axis O. The outer diameter of the hub extension portion 3E is constant over the entire area in the direction of the axis O. In addition, "constant" here means substantially constant, and manufacturing errors and design tolerances are allowed. The outer peripheral surface (extension portion outer peripheral surface Se) of the hub extension portion 3E is connected to the upper end portion of the outer peripheral surface (hub outer peripheral surface Sd) of the diffuser hub 3D. Additionally, it is preferable that the hub outer peripheral surface Sd and the extension portion outer peripheral surface Se be connected to form a smooth curved surface.

Figure 2:
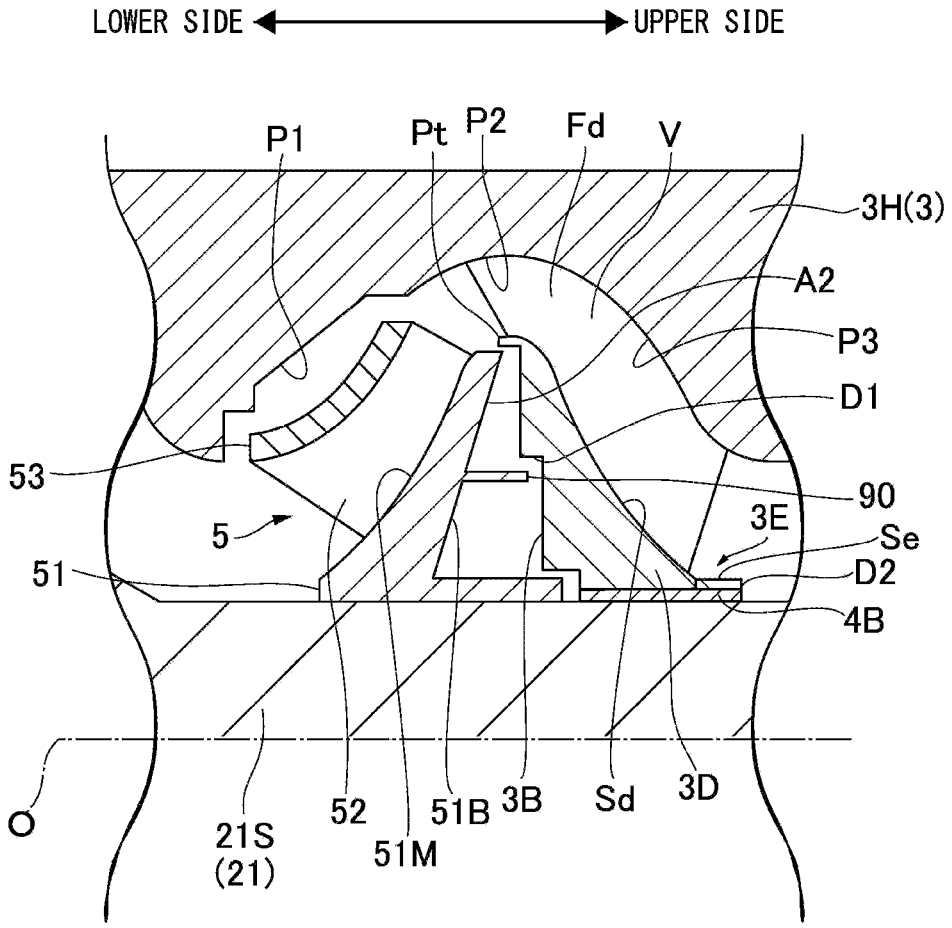
FIG. 2 is a main enlarged cross-sectional view of the crude oil extraction pump according to the first embodiment of the present disclosure.

The upper end surface (stepped surface D2) of the hub extension portion 3E spreads in a direction intersecting the axis O in cross-sectional view including the axis O shown in FIG. 2. More specifically, the stepped surface D2 is formed in an annular shape that spreads within a plane orthogonal to the axis O.

The radial bearing 4B is provided on the inner peripheral side of the diffuser hub 3D and the hub extension portion 3E with such a configuration. The radial bearing 4B is a bearing device which rotatably supports the pump shaft 21S and supports a radial load applied to the pump shaft 21S. More specifically, a sliding bearing is particularly preferably used as the radial bearing 4B. The upper end portion of the radial bearing 4B extends to the upper end portion of the hub extension portion 3E in the direction of the axis O. Additionally, the total radial dimension (thickness) of the radial bearing 4B and the hub extension portion 3E is preferably 3 mm or more and more preferably 5 mm or more.

(Operation and Effect)

Next, the operation of the crude oil extraction pump 100 will be described. In order to operate the crude oil extraction pump 100, the rotor 2 is first rotated by supplying electric power to the motor M. When the rotor 2 rotates, the crude oil in the oil well is sucked up by the pump body P from the opening portion H formed at the lower end of the drilling pipe 9. Further, at this time, the crude oil is also sucked up by the suction flow path Fi formed in the motor rotor 22.

Here, in the above-described crude oil extraction pump 100, since the thrust bearing 4A and the radial bearing 4B are exposed to the stator flow path Fs, the crude oil flowing through the flow path is exposed. Since the crude oil contains slurry, the wear of the sliding surface will be accelerated if slurry flows into these bearings. As a result, the stable operation of the crude oil extraction pump 100 may be hindered. Here, this embodiment adopts the above-described configuration.

According to the above-described configuration, the upper end portion of the diffuser hub 3D is provided with the hub extension portion 3E. Therefore, even when the crude oil flowing along the outer peripheral surface (hub outer peripheral surface Sd) of the diffuser hub 3D contains slurry, the slurry is blocked by the hub extension portion 3E and is less likely to enter the radial bearing 4B. As a result, it is possible to suppress the wear caused by the slurry entering the radial bearing 4B.

Further, according to the above-described configuration, the stepped surface D2 which is the upper end surface of the hub extension portion 3E spreads in a direction intersecting the axis O. Accordingly, a stagnation region is formed above the stepped surface D2 (that is, downstream in the flow direction of the crude oil). Therefore, the crude oil flowing along the outer peripheral surface (hub outer peripheral surface Sd) of the diffuser hub 3D flows downstream while avoiding the stagnation region. As a result, it is possible to further suppress the possibility that the slurry enters the radial bearing 4B even when the crude oil contains slurry.

Additionally, according to the above-described configuration, since the radial bearing 4B extends to the upper end portion of the hub extension portion 3E, it is possible to more stably support the pump shaft by the radial bearing 4B.

Second Embodiment

Figure 3:
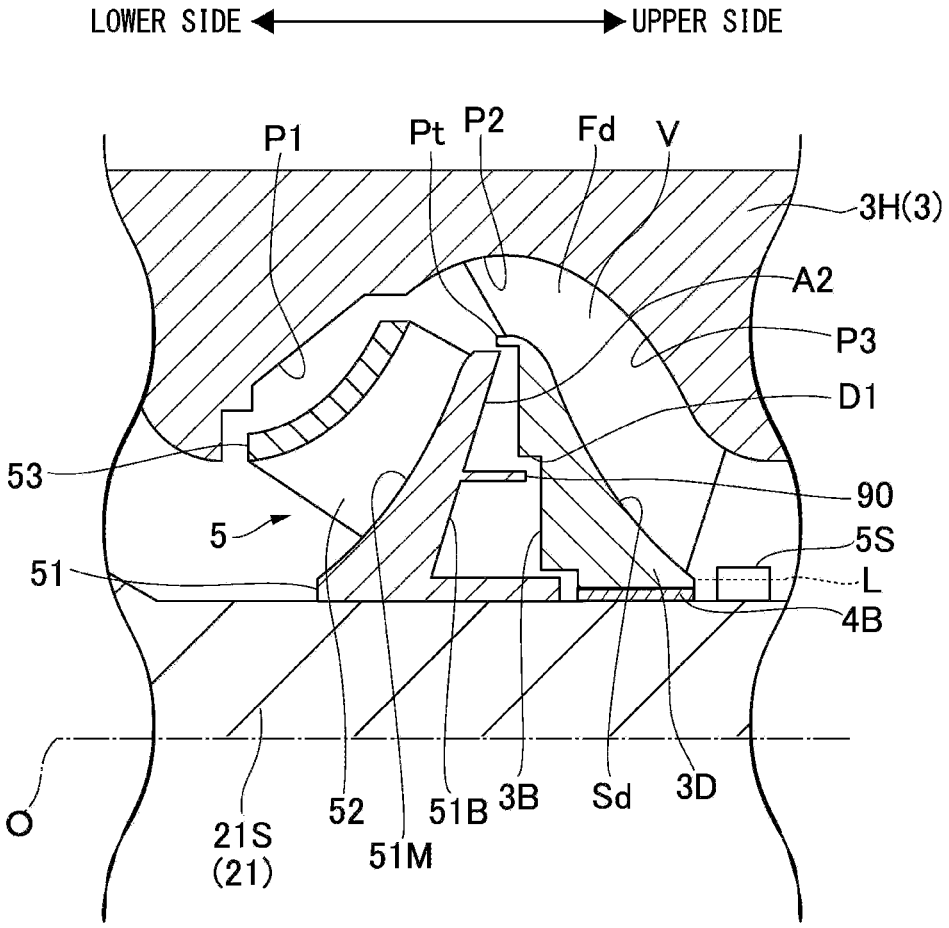
FIG. 3 is a main enlarged cross-sectional view of a crude oil extraction pump according to a second embodiment of the present disclosure.

Next, a second embodiment of the present disclosure will be described with reference to FIG. 3. In addition, the same reference numerals are given to the same configurations as those of the first embodiment, and detailed description thereof is omitted. As shown in the same drawing, in this embodiment, the above-described hub extension portion 3E is not provided. Further, in this embodiment, the pump rotor 21 (pump shaft 21S) further includes an auxiliary impeller 5S. The auxiliary impeller 5S is provided on the outer peripheral surface of the pump shaft 21S and above the diffuser hub 3D. The auxiliary impeller 5S includes a plurality of blades radially protruding from the outer peripheral surface of the pump shaft 21S. In this embodiment, each blade has a rectangular plate shape.

The outer peripheral edge of the auxiliary impeller 5S is located on the radial outside of the extension line L of the outer peripheral surface (hub outer peripheral surface Sd) of the diffuser hub 3D. Additionally, the extension line Lis a virtual line extending in the direction of the axis O from the upper end portion of the hub outer peripheral surface Sd. Further, the auxiliary impeller 5S is provided at a position biased toward the lower impeller 5 in the pair of impellers 5 adjacent to each other. In other words, the auxiliary impeller 5S is provided above and close to the diffuser hub 3D corresponding to the impeller 5 located relatively downward.

According to the above-described configuration, since the auxiliary impeller 5S is provided above the diffuser hub 3D, the flow of the crude oil flowing along the outer peripheral surface (hub outer peripheral surface Sd) of the diffuser hub 3D is stirred by the auxiliary impeller 5S and forms a flow toward the outer peripheral side away from the pump shaft 21S. Since this flow is blocked, the slurry contained in the crude oil moves away from the radial bearing 4B. As a result, it is possible to further suppress the possibility that the slurry enters the radial bearing 4B.

Further, according to the above-described configuration, the outer peripheral edge of the auxiliary impeller 5S is located on the radial outside of the extension line L of the outer peripheral surface (hub outer peripheral surface Sd) of the diffuser hub 3D. Therefore, most of the crude oil flowing along the outer peripheral surface (hub outer peripheral surface Sd) of the diffuser hub 3D can be stirred by the auxiliary impeller 5S. As a result, it is possible to further suppress the possibility that the slurry enters the radial bearing 4B.

Additionally, according to the above-described configuration, the auxiliary impeller 5S is provided at a position biased toward the impeller 5 on the lower side (that is, the upstream side in the flow direction of the crude oil). Accordingly, the crude oil flowing out from the upstream impeller 5 can be immediately stirred by the auxiliary impeller 5S. As a result, it is possible to further suppress the possibility that the slurry enters the radial bearing 4B.

Third Embodiment

Figure 4:
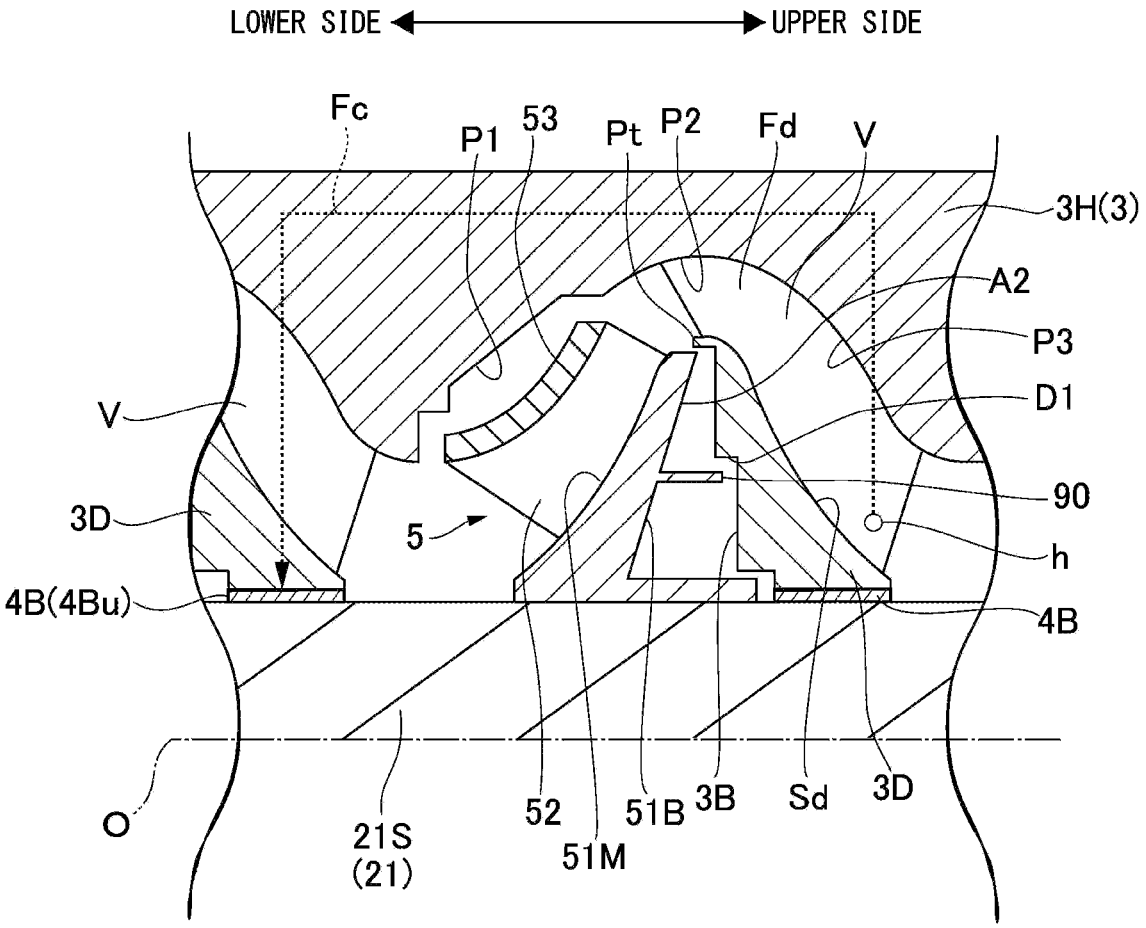
FIG. 4 is a main enlarged cross-sectional view of a crude oil extraction pump according to a third embodiment of the present disclosure.

Next, a third embodiment of the present disclosure will be described with reference to FIGS. 4 and 5. In addition, the same reference numerals are given to the same configurations as those of the above-described embodiments, and detailed description thereof is omitted. As shown in FIG. 4, the crude oil extraction pump 100 according to this embodiment does not include the hub extension portion 3E described in the above-described first embodiment. On the other hand, this crude oil extraction pump 100 further includes a return flow path Fc which returns a part of the working fluid (crude oil) located above to the other radial bearing 4B through the inside of the vane V.

Figure 5:
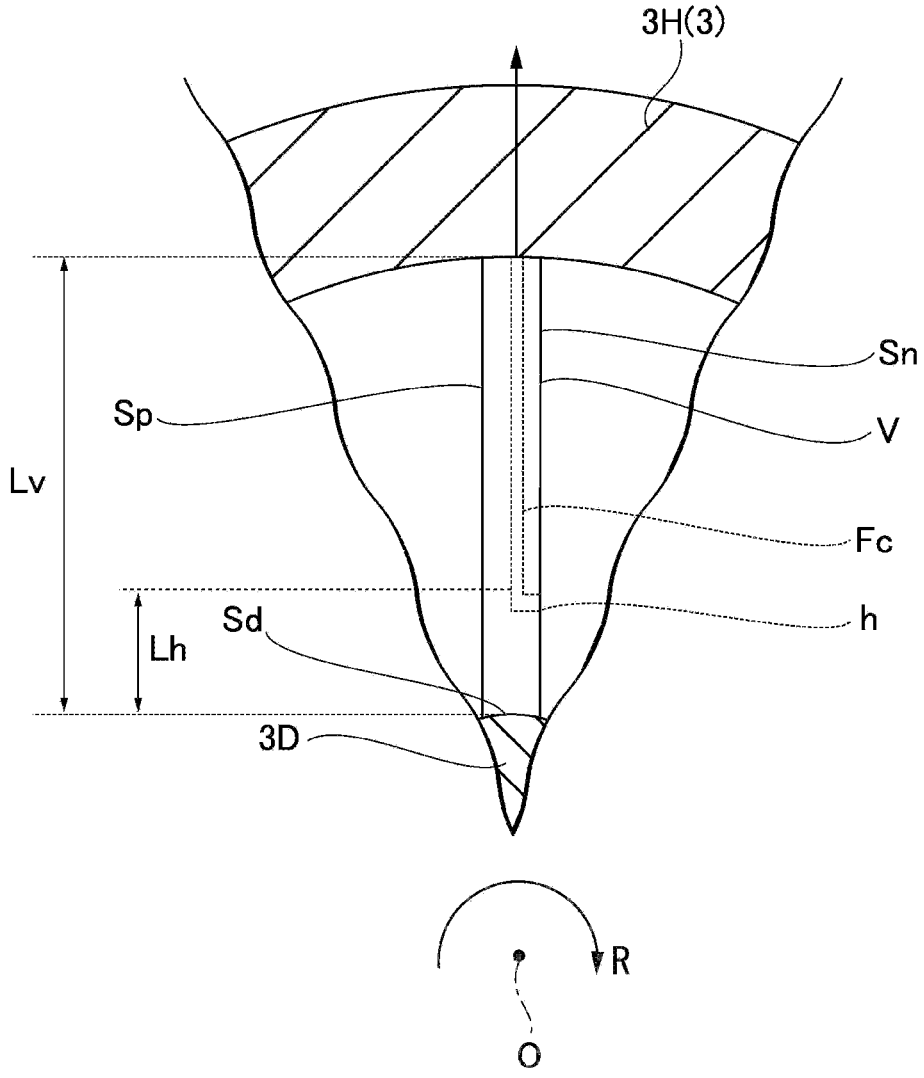
FIG. 5 is a view in which a vane according to the third embodiment of the present disclosure is viewed from an axial direction.

As shown in FIG. 5, one end of the return flow path Fc is an opening portion h that is opened on a negative pressure surface Sn of the vane V. Additionally, the negative pressure surface Sn here means a surface facing the front side of the rotation direction R of the pump shaft 21S in both surfaces of the vane V in the thickness direction. A surface facing the rear side of the rotation direction R of the vane Vis a positive pressure surface Sp. Further, as shown in FIG. 4, the opening portion h is formed in the range of 1/10 or more and 1/2 or less of the radial dimension of the vane with reference to the inner peripheral edge (that is, the hub outer peripheral surface Sd) of the negative pressure surface Sn of the vane V. In other words, when the radial dimension of the vane V is Lv, the dimension Lh from the hub outer peripheral surface Sd to the opening portion h satisfies a relationship of $\frac{1}{10}Lv \leq Lh \leq \frac{1}{2}Lv$.

The return flow path Fc extends from this opening portion h to the sliding surface of the lower (upstream) radial bearing 4B (upstream radial bearing 4Bu) through the inside of the vane V and the inside of the stator body 3H.

Here, the amount of slurry contained in the crude oil is relatively small on the side of the negative pressure surface Sn of the vane V. In the above-described configuration, a part of the working fluid (crude oil) can be extracted from a region on the side of the negative pressure surface Sn having a small amount of slurry and returned to the radial bearing 4B located at the lower side (that is, the upstream side) through the return flow path Fc. Accordingly, it is possible to further improve the lubricating performance of the lower radial bearing 4B. Further, even when slurry enters the lower radial bearing 4B, this slurry can be easily discharged by the crude oil having a small amount of slurry supplied through the return flow path Fc.

In particular, the amount of slurry particularly tends to be small in the range of 1/10 or more and 1/2 or less of the radial dimension of the vane V with reference to the inner peripheral edge on the side of the negative pressure surface Sn. According to the above-described configuration, since one end (opening portion h) of the return flow path Fc is formed in such a range, the crude oil having a small amount of slurry can be further returned and supplied to the flow path Fc.

Other Embodiments

As described above, the embodiments of the present disclosure have been described with reference to the drawings, but the detailed configuration is not limited to these embodiments and design changes and the like are also included in the range not departing from the spirit of the present disclosure. For example, the hub extension portion 3E described in the above-described first embodiment can be applied to each of the configurations described in the second embodiment and the third embodiment in combination.

Further, in the third embodiment, an example has been described in which the return flow path Fc extends from the upper vane V toward the radial bearing 4B adjacent to the vane V. However, the aspect of the return flow path Fc is not limited to the above-described example and a configuration can be adopted in which the return flow path is connected to the radial bearing 4B located at two or more stages below the upper vane V.

APPENDIX

The crude oil extraction pump described in each embodiment is understood, for example, as below.

(1) The crude oil extraction pump 100 according to a first aspect includes: the production pipe 1 having a tubular shape along the axis O extending in the vertical direction; the pump rotor 21 extending in the direction of the axis O inside the production pipe 1; and the pump stator 3 which is provided between the production pipe 1 and the pump rotor 21 to surround the pump rotor 21, wherein the pump rotor 21 includes the pump shaft 21S extending in the direction of the axis O and the impeller 5 which is provided in multiple stages in the pump shaft 21S and rotated together with the pump shaft 21S to pump the crude oil upward, and wherein the pump stator 3 includes the stator body 3H having a tubular shape extending along the axis O, the plurality of vanes V protruding radially inward in the axis O from the inner peripheral surface of the stator body 3H and are provided above the respective impellers 5, the diffuser hub 3D which is formed on the radial inside of the vane V, the bearing device (radial bearing 4B) which is installed on the inner peripheral side of the diffuser hub 3D and rotatably supporting the pump shaft 21S, and the hub extension portion 3E which is formed at the upper end portion of the diffuser hub 3D and having an outer peripheral surface (hub outer peripheral surface Sd) having a constant outer diameter centered on the axis O.

According to the above-described configuration, the upper end portion of the diffuser hub 3D is provided with the hub extension portion 3E. Therefore, even when slurry is contained in the crude oil flowing along the outer peripheral surface of the diffuser hub 3D, slurry is blocked by the hub extension portion 3E and is less likely enter the bearing device (radial bearing 4B). As a result, it is possible to suppress the wear caused by the slurry entering the radial bearing 4B.

(2) In the crude oil extraction pump 100 according to a second aspect, the upper end surface of the hub extension portion 3E may be the stepped surface D2 that spreads in a direction intersecting the axis O in cross-sectional view including the axis O.

According to the above-described configuration, the stepped surface D2 which is the upper end surface of the hub extension portion 3E spreads in a direction intersecting the axis O. Accordingly, a stagnation region is formed above the stepped surface D2 (that is, the downstream side of the flow direction of the crude oil). Therefore, the crude oil flowing along the outer peripheral surface of the diffuser hub 3D flows downstream while avoiding the stagnation region. As a result, it is possible to further suppress the possibility that the slurry enters the bearing device (radial bearing 4B) even when the crude oil contains slurry.

(3) In the crude oil extraction pump 100 according to a third aspect, the bearing device (radial bearing 4B) may be extended to the upper end portion of the hub extension portion 3E in the direction of the axis O.

According to the above-described configuration, since the bearing device (radial bearing 4B) extends to the upper end portion of the hub extension portion 3E, it is possible to more stably support the pump shaft 21S by the bearing device (radial bearing 4B).

(4) In the crude oil extraction pump 100 according to a fourth aspect, the pump rotor 21 may further include the auxiliary impeller 5S which is formed on the outer peripheral surface of the pump shaft 21S and above the diffuser hub 3D.

According to the above-described configuration, since the auxiliary impeller 5S is provided above the diffuser hub 3D, the flow of the crude oil flowing along the outer peripheral surface of the diffuser hub 3D is stirred by the auxiliary impeller 5S and forms a flow toward the outer peripheral side away from the pump shaft 21S. Since this flow is blocked, the slurry contained in the crude oil moves away from the bearing device (radial bearing 4B). As a result, it is possible to further suppress the possibility that the slurry enters the bearing device (radial bearing 4B).

(5) In the crude oil extraction pump 100 according to a fifth aspect, the outer peripheral edge of the auxiliary impeller 5S may be located on the radial outside of the extension line L of the outer peripheral surface of the diffuser hub 3D.

According to the above-described configuration, the outer peripheral edge of the auxiliary impeller 5S is located on the radial outside of the extension line L of the outer peripheral surface of the diffuser hub 3D. Therefore, most of the crude oil flowing along the outer peripheral surface of the diffuser hub 3D can be stirred by the auxiliary impeller 5S. As a result, it is possible to further suppress the possibility that the slurry enters the bearing device (radial bearing 4B).

(6) In the crude oil extraction pump 100 according to a sixth aspect, the auxiliary impeller 5S may be installed at a position biased toward the lower impeller 5 in the pair of impellers 5 adjacent to each other.

According to the above-described configuration, the auxiliary impeller 5S is provided at a position biased toward the impeller 5 on the lower side (that is, the upstream side in the flow direction of the crude oil). Accordingly, the crude oil flowing out from the upstream impeller 5 can be immediately stirred by the auxiliary impeller 5S. As a result, it is possible to further suppress the possibility that the slurry enters the bearing device (radial bearing 4B).

(7) The crude oil extraction pump 100 according to a seventh aspect may further include the return flow path Fc which is formed to extract a part of the working fluid from the side of the negative pressure surface Sn of the vane V provided adjacent to the upper impeller 5 among the multiple stages of impellers 5 and return the working fluid to the bearing device (radial bearing 4B) provided adjacent to the lower impeller 5 and one end of the return flow path Fc may be opened on the negative pressure surface Sn of the vane V.

Here, the amount of slurry contained in the crude oil is relatively small on the side of the negative pressure surface Sn of the vane. In the above-described configuration, a part of the working fluid (crude oil) can be extracted from a region on the side of the negative pressure surface Sn having a small amount of slurry and returned to the bearing device (radial bearing 4B) located on the lower side (that is, upstream side) through the return flow path Fc. Accordingly, it is possible to further improve the lubricating performance of the lower bearing device (radial bearing 4B). Further, even when slurry enters the lower bearing device (radial bearing 4B), this slurry can be easily discharged by the crude oil having a small amount of slurry supplied through the return flow path Fc.

(8) In the crude oil extraction pump 100 according to an eighth aspect, one end of the return flow path Fc may be formed in the range of 1/10 or more and 1/2 or less of the radial dimension of the vane V with reference to the inner peripheral edge of the negative pressure surface Sn of the vane V.

Here, the amount of slurry particularly tends to be small in the range of 1/10 or more and 1/2 or less of the radial dimension of the vane V with reference to the inner peripheral edge on the side of the negative pressure surface Sn. According to the above-described configuration, since one end of the return flow path Fc is formed in such a range, the crude oil having a small amount of slurry can be further returned and supplied to the flow path Fc.

(9) A the crude oil extraction pump 100 according to a ninth aspect may include: the production pipe 1 having a tubular shape along the axis O extending in the vertical direction; the pump rotor 21 extending in the direction of the axis O inside the production pipe 1; and the pump stator 3 which is provided between the production pipe 1 and the pump rotor 21 to surround the pump rotor 21, wherein the pump rotor 21 may include the pump shaft 21S extending in the direction of the axis O and the impeller 5 which is provided in multiple stages in the pump shaft 21S and rotated together with the pump shaft 21S to pump the crude oil upward, wherein the pump stator 3 may include the stator body 3H having a tubular shape extending along the axis O, the plurality of vanes V protruding radially inward in the axis O from the inner peripheral surface of the stator body 3H and are provided above the respective impellers 5, the diffuser hub 3D which is formed on the radial inside of the vane V, and the bearing device (radial bearing 4B) which is installed on the inner peripheral side of the diffuser hub 3D and rotatably supporting the pump shaft 21S, and wherein the pump rotor 21 may further include the auxiliary impeller 5S which is formed on the outer peripheral surface of the pump shaft 21S and above the diffuser hub 3D.

According to the above-described configuration, since the auxiliary impeller 5S is provided above the diffuser hub 3D, the flow of the crude oil flowing along the outer peripheral surface of the diffuser hub 3D is stirred by the auxiliary impeller 5S and forms a flow toward the outer peripheral side away from the pump shaft 21S. Since this flow is blocked, the slurry contained in the crude oil moves away from the bearing device (radial bearing 4B). As a result, it is possible to further suppress the possibility that the slurry enters the bearing device (radial bearing 4B).

(10) In the crude oil extraction pump 100 according to a tenth aspect, the outer peripheral edge of the auxiliary impeller 5S may be located on the radial outside of the extension line L of the outer peripheral surface of the diffuser hub 3D.

According to the above-described configuration, the outer peripheral edge of the auxiliary impeller 5S is located on the radial outside of the extension line L of the outer peripheral surface of the diffuser hub 3D. Therefore, most of the crude oil flowing along the outer peripheral surface of the diffuser hub 3D can be stirred by the auxiliary impeller 5S. As a result, it is possible to further suppress the possibility that the slurry enters the bearing device (radial bearing 4B).

(11) In the crude oil extraction pump 100 according to an eleventh aspect, the auxiliary impeller 5S may be installed at a position biased toward the lower impeller 5 in the pair of impellers 5 adjacent to each other.

According to the above-described configuration, the auxiliary impeller 5S is provided at a position biased toward the impeller 5 on the lower side (that is, the upstream side in the flow direction of the crude oil). Accordingly, the crude oil flowing out from the upstream impeller 5 can be immediately stirred by the auxiliary impeller 5S. As a result, it is possible to further suppress the possibility that the slurry enters the bearing device (radial bearing 4B).

(12) The crude oil extraction pump 100 according to a twelfth aspect may include: the production pipe 1 having a tubular shape along the axis O extending in the vertical direction; the pump rotor 21 extending in the direction of the axis O inside the production pipe 1; and the pump stator 3 which is provided between the production pipe 1 and the pump rotor 21 to surround the pump rotor 21, wherein the pump rotor 21 may include the pump shaft 21S extending in the direction of the axis O and the impeller 5 which is provided in multiple stages in the pump shaft 21S and rotated together with the pump shaft 21S to pump the crude oil upward, wherein the pump stator 3 may include the stator body 3H having a tubular shape extending along the axis O, the plurality of vanes V protruding radially inward in the axis O from the inner peripheral surface of the stator body 3H and are provided above the respective impellers 5, the diffuser hub 3D which is formed on the radial inside of the vane V, and the bearing device (radial bearing 4B) which is installed on the inner peripheral side of the diffuser hub 3D and rotatably supporting the pump shaft 21S, wherein the crude oil extraction pump further may include the return flow path Fc which is formed to extract a part of the working fluid from the side of the negative pressure surface Sn of the vane V provided adjacent to the upper impeller 5 among multiple stages of impellers 5 and returns the working fluid to the bearing device (radial bearing 4B) provided adjacent to the lower impeller 5, and wherein one end of the return flow path Fc may be opened on the negative pressure surface Sn of the vane V.

Here, the amount of slurry contained in the crude oil is relatively small on the side of the negative pressure surface Sn of the vane. In the above-described configuration, a part of the working fluid (crude oil) can be extracted from a region on the side of the negative pressure surface Sn having a small amount of slurry and returned to the bearing device (radial bearing 4B) located on the lower side (that is, upstream side) through the return flow path Fc. Accordingly, it is possible to further improve the lubricating performance of the lower bearing device (radial bearing 4B). Further, even when slurry enters the lower bearing device (radial bearing 4B), this slurry can be easily discharged by the crude oil having a small amount of slurry supplied through the return flow path Fc.

(13) In the crude oil extraction pump 100 according to a thirteenth aspect, one end of the return flow path Fc may be formed in a range of 1/10 or more and 1/2 or less of the radial dimension of the vane V with reference to the inner peripheral edge of the negative pressure surface Sn of the vane V.

Here, the amount of slurry particularly tends to be small in the range of 1/10 or more and 1/2 or less of the radial dimension of the vane V with reference to the inner peripheral edge on the side of the negative pressure surface Sn. According to the above-described configuration, since one end of the return flow path Fc is formed in such a range, the crude oil having a small amount of slurry can be further returned and supplied to the flow path Fc.

REFERENCE SIGNS LIST

100 Crude oil extraction pump
1 Production pipe
1A Production pipe body
1B Production pipe tip
2 Rotor
21 Pump rotor
21S Pump shaft
22 Motor rotor
22M Magnetic member
3 Pump stator
3B Hub bottom surface
31 Stator extension portion
3D Diffuser hub
3H Stator body
30 Spline coupling
4 Support portion
4A Thrust bearing
4B Radial bearing
5 Impeller
51 Disk
51B Disk back surface
51M Disk main surface
52 Blade
53 Shroud cover
6 Thrust collar
7 Thrust pad
9 Drilling pipe
90 Partition portion
C Coil
D1 Stepped portion D2 Stepped surface
Fc Return flow path
Fd Diffuser flow path
Fi Suction flow path
Fs Stator flow path
H, h Opening portion
M Motor
O Axis
P1 Facing surface
P2 Connection surface
P3 Downstream surface
Pt Protrusion portion
Sn Negative pressure surface
Sp Positive pressure surface
V Vane

What is claimed is:

1. A crude oil extraction pump comprising:

a production pipe having a tubular shape along an axis extending in a vertical direction;

a pump rotor extending in a direction of the axis inside the production pipe; and a pump stator which is provided between the production pipe and the pump rotor to surround the pump rotor, wherein the pump rotor includes a pump shaft extending in the direction of the axis, and a plurality of impeller provided on the pump shaft and rotated together with the pump shaft to pump crude oil upward, and wherein the pump stator includes a stator body having a tubular shape extending along the axis, a plurality of vanes protruding radially inward from an inner peripheral surface of the stator body and are provided above each impeller of the plurality of impellers, a diffuser hub which is formed on the radial inside of the plurality of vanes, a bearing device which is installed on an inner peripheral side of the diffuser hub and rotatably supporting the pump shaft, and a hub extension portion which is formed at an upper end portion of the diffuser hub and having an outer peripheral surface having a constant outer diameter centered on the axis, wherein the crude oil extraction pump further comprises a return flow path, wherein the return flow path is formed to extract a part of a working fluid from a negative pressure surface side of a corresponding vane of the plurality of vanes, the corresponding vane provided adjacent to an upper impeller of the plurality of impellers, and to return the part of the working fluid to a bearing device provided adjacent to a lower impeller of the plurality of impellers, and wherein one end of the return flow path is opened on the negative pressure surface of the corresponding vane.

2. The crude oil extraction pump according to claim 1, wherein an upper end surface of the hub extension portion spreads in a direction intersecting the axis in a cross-sectional view including the axis.

3. The crude oil extraction pump according to claim 1, wherein the bearing device is extended to an upper end portion of the hub extension portion in an axial direction.

4. The crude oil extraction pump according to claim 1, wherein the pump rotor further includes an auxiliary impeller which is formed on an outer peripheral surface of the pump shaft and above the diffuser hub.

5. The crude oil extraction pump according to claim 4, wherein an outer peripheral edge of the auxiliary impeller is located on a radial outside of an extension line of an outer peripheral surface of the diffuser hub.

6. The crude oil extraction pump according to claim 4, wherein the auxiliary impeller is installed at a position biased toward a lower impeller in an adjacent pair of impellers in the plurality of impellers.

7. The crude oil extraction pump according to claim 1, wherein the one end of the return flow path is formed in a range of 1/10 or more and 1/2 or less of a radial dimension of the corresponding vane with reference to an inner peripheral edge of the negative pressure surface of the corresponding vane.

* * * * *